United States Patent [19]

Oelke

[11] 4,181,377

[45] Jan. 1, 1980

[54] ROCK BIT HAVING AN IMPROVED CONE RETENTION SYSTEM

[75] Inventor: Erwin S. Oelke, Cypress, Calif.

[73] Assignee: Smith International, Inc., Newport Beach, Calif.

[21] Appl. No.: 919,330

[22] Filed: Jun. 26, 1978

[51] Int. Cl.[2] ..... F16C 33/66

[52] U.S. Cl. ..... 308/8.2; 308/DIG. 11

[58] Field of Search ..... 308/8.2, DIG. 11

[56] References Cited

U.S. PATENT DOCUMENTS

| | | | |
|---|---|---|---|
| 2,654,577 | 10/1953 | Green | 308/8.2 |
| 3,971,600 | 7/1976 | Murdoch et al. | 308/8.2 |

*Primary Examiner*—Douglas C. Butler

*Attorney, Agent, or Firm*—Robert M. Vargo

[57] ABSTRACT

A rotary drill bit having a cone retention system that eliminates the utilization of ball bearings. The drill bit comprises a main bit body having a plurality of legs extending downwardly therefrom. Each leg includes a journal for rotatively supporting a cone cutter. Each cone is retained on a respective journal by a plurality of segmented annular thrust members which extend into an internal annular groove formed within the cone cavity. The segmented thrust member also bears against a shoulder formed on the journal and is retained against the shoulder by a flanged member which, in turn, is threadedly secured to the journal. The threaded portion of the flanged member is relatively large to absorb the loads passing therethrough. A small aperture is also provided in the journal to receive a screw driver element which, in turn, is utilized to thread the flanged member onto the journal. After the threading operation is complete, the aperture is plugged with a weld to prevent the screw driver element from rotating.

8 Claims, 6 Drawing Figures

ROCK BIT HAVING AN IMPROVED CONE RETENTION SYSTEM

BACKGROUND OF THE INVENTION

1. Field of the Invention

The present invention relates generally to rotary rock bits having rotating cone cutters and, more particularly, to means for retaining the cone cutters on the rock bit assemblies.

2. Description of the Prior Art

A rotary rock bit generally consists of a main bit body adapted to be connected to a rotary drill string. A conventional bit usually includes two or more legs integrally connected with each leg assembly including a cone cutter rotatively mounted on a journal pin extending from the leg. Bearing assemblies are provided between the interengaging surfaces of each cone and journal pin to promote rotation of the cone. Finally, means are provided on the outer surface of the cone for disintegrating the formation as the bit and cone rotate.

Various types of bearings are utilized in the leg assemblies in various combinations. In present day rock bits, the two most prevalent combinations are: (a) the roller-ball-friction bearing system; and (b) the friction-ball-friction or solid journal bearing system. As noted, both systems utilize ball bearings. In a ball bearing assembly, the balls are inserted through a ball hole into a race formed by grooves located in opposed surfaces of the cone and journal. The main reason for utilizing ball bearing assemblies is that the ball bearings also function to retain the cones on the journal. The shortcoming with such a utilization is that the ball bearing assemblies cannot absorb or efficiently transfer any of the axial loads acting on the cones. Therefore, ball bearing assemblies have been utilized more for their cone retention ability than for their load bearing capability.

Before ball bearings were utilized, various types of ring members were used to retain the cone on the journal. However, these designs suffered from various shortcomings that none of them are used on present day rock bit configurations. The following is a list of patents illustrating early day cone retention systems: U.S. Pat. Nos. 1,835,523, 1,865,706, 1,989,261, 2,058,624, 2,086,397 and 3,239,431.

SUMMARY OF THE INVENTION

The present invention provides a rotary rock bit with a novel cone retention system that eliminates ball bearing assemblies and obviates the shortcomings found in early day rock bit designs.

In its broadest aspect, the present invention pertains to a rotary rock bit having a solid journal bearing system in which the cone is retained onto the journal by means of an annular thrust member extending into a groove formed in the cone. The thrust member is also urged and retained against a shoulder formed on the journal by a flanged element which is threadedly secured to the journal. The journal also has an aperture formed therein for receiving a screw driver element which functions to screw the flanged element onto the journal. The aperture is then plugged with a weld to prevent the screw driver element from rotating.

A primary advantage of the present invention is that the threaded portion of the flanged element is relatively large in order to absorb the thrust forces passing therethrough.

Another advantage of the present invention is that the aperture and screw driver element are relatively small in diameter to enable the base of the journal pin to absorb the very high journal loads acting thereon.

The features of the present invention, which are believed to be novel, are set forth with particularity in the appended claims. The present invention, both as to its organization and manner of operation, together with the further advantage thereof, may best be understood by reference to the following description taken in connection with the accompanying drawings.

DESCRIPTION OF THE PREFERRED EMBODIMENT

Figure 1:
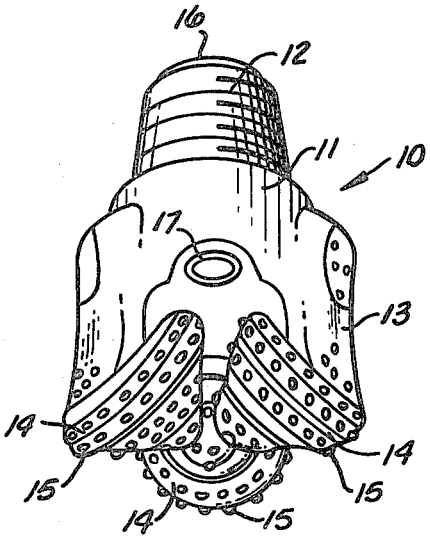
FIG. 1 is a perspective view of a rotary rock bit.

Referring now to the drawings, FIG. 1 illustrates a three cone rotary rock bit, although the invention can be utilized in other types of rock bits. The rotary rock bit, generally indicated by arrow 10, comprises a bit body 11 having an upper threaded portion 12 for connection to the lower end of a rotary drill string (not shown). Extending downwardly from the bit body 11 are three substantially identical legs 13.

Figure 5:
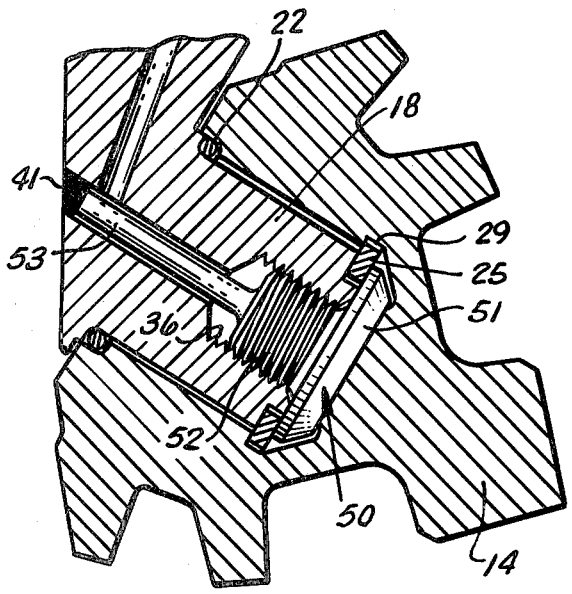
FIG. 5 is a fragmentary sectional view of a leg assembly illustrating a second embodiment of the present invention.
Figure 6:
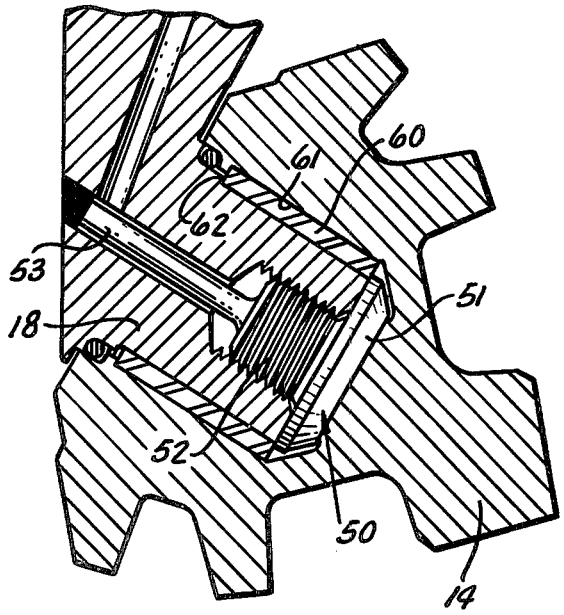
FIG. 6 is a fragmentary sectional view of a leg assembly illustrating a third embodiment of the present invention.

The rotary cone cutter 14 is rotatively mounted on each leg assembly 13, with each cone cutter 14 having a cutting structure 15 on its outer surface which is adapted to disintegrate the formations as the bit is rotated. The cutting structure 15 is shown in the form of tungsten carbide inserts, however, other cutting structures such as milled steel teeth formed on the cone cutters may be utilized and are illustrated in FIGS. 2, 5 and 6.

The bit 10 further includes a central passageway 16 extending along the center axis of body 11 to allow drilling fluid to enter from the upper section of the drill string immediately above and pass downward through three jet nozzles 17, one of which is shown in FIG. 1.

In operation, the drill bit 10 is connected as a lower member of a rotary drill string (not shown) and lowered into a well bore until the rotatable cone cutters 14 engage the bottom of the well bore. Upon engagement with the bottom well bore the drill string and the bit 10 are rotated. Drilling fluid is forced down through the interior passage of the rotary drill string and through the central passageway 16 of the bit 10. The drilling fluid then passes through the three nozzles 17, past the cutting structure 15 of the cutter 14 to the bottom of the well bore, and then upwardly into the annulus between the rotary drill string and the wall of the well bore carrying with it the cuttings and debris from the drilling operation.

Figure 2:
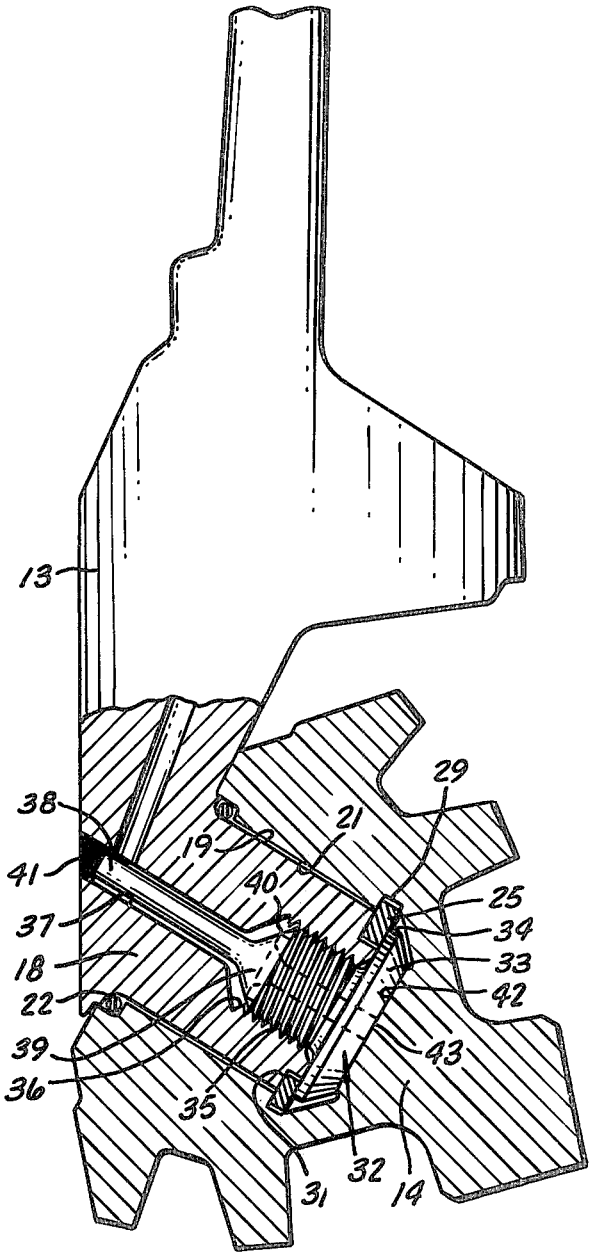
FIG. 2 is a view, partially in section, of a rock bit leg assembly utilizing the cone retention means of the present invention.

Referring now to FIG. 2, one leg 13 of the rotary rock bit 10 is shown. The cone cutter 14 is rotatively mounted on a journal pin 18 extending out of the leg 13. The journal 18 includes a cylindrical bearing surface 19 which opposes and engages an inner cylindrical surface 21 of the cone cutter 14.

A seal 22 is positioned within a groove 23 formed at the base of the cone cutter 14 for preventing lubricant from the bearing area to escape to the exterior of the bit. The seal 22 also functions to prevent drilling fluid and other debris from entering the bearing area of the leg assembly from the exterior of the bit. It should be noted that the present invention is also applicable to open bearing bits in which a seal is not provided.

The cone cutter 14 is retained on the journal 18 by means of an annular thrust member 25. In the present embodiment, the annular thrust member 25 is divided into three segments 26, 27 and 28 which are adapted to extend into a groove 29 formed in the cone cutter 14.

Figure 3:
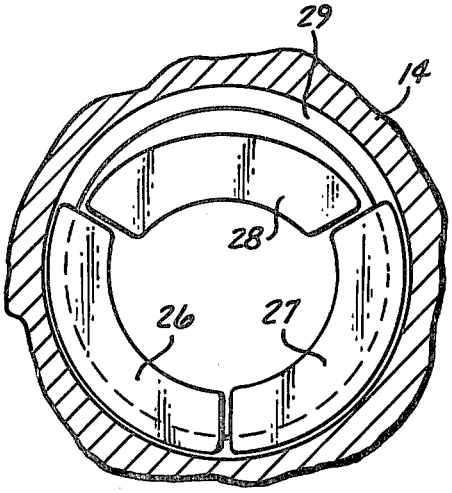
FIG. 3 is a fragmentary view, partially in section, of the segmented thrust members being inserted into the cone.
Figure 4:
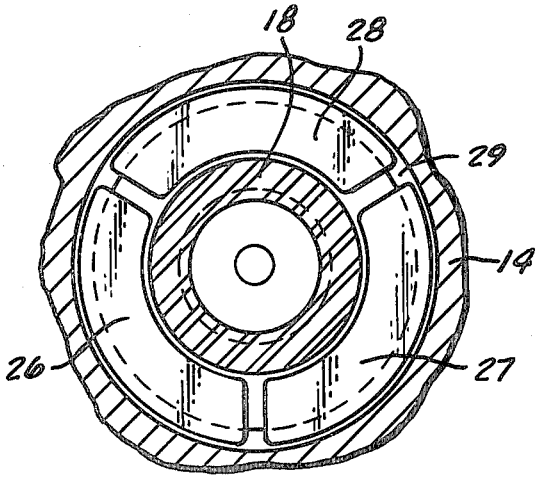
FIG. 4 is a fragmentary view, partially in section, of the segmented thrust members in final assembly.

As shown in FIG. 3, the initial segments 26 and 27 are positioned within the groove 29 after which there is still sufficient room to enable the third segment 28 to pass through the interior of the cone cutter 14 and slide up into the groove 29. The three segments 26, 27 and 28 are then positioned circumferentially within the groove 29 as shown in FIG. 4 to enable the journal pin 18 to extend through the interior area formed by the segmented thrust members.

The segmented thrust member 25 is also urged and retained into engagement with a shoulder 31 of the journal 18 by means of a flanged element, generally indicated by arrow 32.

The flanged element 32 is a T shaped member having an outer flange 33 positioned within a recess 34 formed at the inner end of the cone cavity. The flanged element 32 further includes a threaded portion 35 which is adapted to be threadedly connected to a threaded bore 36 formed in the journal 18.

The journal 18 further includes a second aperture 37 extending from the threaded bore 36 to the exterior of the leg 13 for receiving a driver element 38 having a face 39 which is adapted to extend into a groove 40 formed within the threaded portion 35 of the flanged element 32.

In assemblying the cone onto the leg assembly, the flanged element 32 is initially positioned within the cavity of the cone cutter 14 with the outer flange 33 resting in the recess 34. Afterwards, the first two segments 26 and 27 are positioned within the groove 29. Immediately thereafter, the third segment 28 is positioned within the groove 29.

The driver element 38 is then dropped into the aperture 37 from the interior end of the journal 18 through the threaded bore 36. After the seal 22 is inserted within the groove 29, the cone cutter 14 is then positioned over the journal 18 until the threaded portion of the flanged element 32 contacts the initial thread of the threaded bore 36.

A special tool extension such as a screwdriver, not shown, is then adapted to engage the one end of the driver element 38 through the aperture 37 to threadedly rotate the driver face 39 into the threaded portion 35.

Upon completely threading the threaded portion 35 of the flanged member 32 into the threaded bore 36, as shown in FIG. 2, the open end of the aperture 38 is plugged by a weld 41 which also functions to lock the driver element 38 in position to prevent it and the flanged member 32 from rotating due to vibration. It should be noted that only a small retaining force is required since during operation, the frictional engagement of the thrust face 42 of the cone 14 with the thrust face 43 of the flanged member 32 functions to rotate the flanged member 32 in the same direction as the threading rotation, thereby making the threaded connection even tighter.

An advantage of the present embodiment is that the threaded portion 35 of the flanged member 32 is relatively large thereby enabling the flanged member 32 to absorb the thrust forces passing therethrough. However, it should also be noted that the diameter of the aperture 37 and the driver element 38 are relatively small at the base of the journal pin 18 to enbale the base of the journal pin 18 to have sufficient strength to withstand the high bending loads acting thereon. Therefore, upon assembly, the flanged element 32 functions to urge the annular thrust element 25 against the shoulder 31 of the journal 18 to fix the thrust element 25 in position. By extending into the groove 29, the thrust element 25 functions to retain the cone cutter 14 on the journal 18.

Referring now to FIG. 5, a second embodiment is illustrated in which the flanged member and the driving element are integral to form a one piece flanged member 50 comprising a flanged portion 51, a threaded portion 52 and a drive element 53. The flanged member 51 functions the same as the first embodiment of the present invention by extending over the annular thrust member 25 with the threaded portion 52 adapted to be threaded into the threaded bore 36 of the journal 18 by action of the drive element 53.

In the embodiment shown in FIG. 6, the flanged member 50 is similar to the one utilized in FIG. 5. The only difference in the third embodiment is that the annular thrust member is formed by a plurality of segmented sleeve sections 60 which are much wider than the segments shown in the first embodiment. The segmented sleeve members 60 are adapted to extend into a groove 61 formed in the cutter 14 and are adapted to be urged and retained against the shoulder 62 formed in the journal 18. In all other respects, the cone retention system in FIG. 6 functions the same as the first two embodiments. An advantage of the third embodiment is that the segmented sleeve members 60 also function as radial friction bearings for the bearing assembly.

As can be seen, a novel cone retention system is utilized in a rotary rock bit that not only eliminates ball bearings but overcomes all of the deficiencies found in prior cone retention systems.

It should be noted that various modifications can be made to the assembly while still remaining within the purview of the following claims.

What is claimed is:

1. A rotary rock bit comprising a main bit body having a plurality of legs extending downwardly therefrom, each leg having a journal with a bearing surface formed thereon, a cone cutter having an interior cavity rotatively supported on the bearing surface of each journal, and means for retaining each cone cutter on each respective journal, each retaining means comprising:

an annular thrust member adapted to extend into a groove formed in the interior cavity of the respective cone cutter, said thrust member comprising a plurality of arcuate segments extending substantially the entire bearing surface between the cone cutter and the journal to enable the segments to function as friction bearings for the legcutter assembly; and means for urging each thrust member against a shoulder formed on said registering journal, said urging means comprising a retaining member having a flanged portion extending radially outwardly to engage said thrust member, said retaining member further having a securing portion which is adapted to be secured to said journal, said securing portion having a diameter sufficient to effectively resist the thrust loads generated from the cone cutter.

2. The combination of claim 1 wherein said securing portion comprises a threaded portion adapted to threadedly engage a threaded bore formed in said journal.

3. The combination of claim 2 wherein said retaining member includes a third portion extending through an aperture formed in said journal, said third portion and said aperture being of a relatively smaller diameter than said threaded portion and threaded bore.

4. The combination of claim 3 wherein each aperture extends through said journal to the exterior of said leg, thereby enabling said third portion to be rotated from outside the leg in order for the third portion to drivingly rotate said threaded portion of the retainer member.

5. The combination of claim 4 further including a weld for plugging each aperture opening through each leg, each weld further engaging said third portion for securing said third portion against rotation.

6. The combination of claim 3 wherein each third portion is integral with said threaded portion of each retaining member.

7. The combination of claim 3 wherein each third portion is separate from said threaded portion and is adapted to be drivingly engaged therewith to rotate said threaded portion.

8. The combination of claim 7 wherein each third portion includes a head adapted to mate with a registering face of said threaded portion.

* * * * *